US007182688B2

(12) United States Patent
Coulton

(10) Patent No.: US 7,182,688 B2
(45) Date of Patent: Feb. 27, 2007

(54) ROLLABLE ROOF RIDGE VENT HAVING BAFFLES

(75) Inventor: Michael S Coulton, North Wales, PA (US)

(73) Assignee: Benjamin Obdyke Incorporated, Horsham, PA (US)

( * ) Notice: Subject to any disclaimer, the term of this patent is extended or adjusted under 35 U.S.C. 154(b) by 0 days.

(21) Appl. No.: 11/000,742

(22) Filed: Dec. 1, 2004

(65) Prior Publication Data

US 2005/0136831 A1 Jun. 23, 2005

Related U.S. Application Data

(60) Provisional application No. 60/532,033, filed on Dec. 22, 2003.

(51) Int. Cl.
*F24F 13/08* (2006.01)

(52) U.S. Cl. ..... 454/365; 454/366; 52/198; 52/199

(58) Field of Classification Search ..... 454/364, 454/365, 366; 52/198, 199
See application file for complete search history.

(56) References Cited

U.S. PATENT DOCUMENTS

| | | | | |
|---|---|---|---|---|
| 1,717,728 | A | | 6/1929 | Moore |
| 2,200,031 | A | | 5/1940 | Lee |
| 2,214,183 | A | | 9/1940 | Seymour |
| 2,704,500 | A | | 3/1955 | Bonforte |
| 2,799,214 | A | | 7/1957 | Roose |
| 2,868,104 | A | | 1/1959 | Honholt et al. |
| 3,185,070 | A | | 5/1965 | Smith |
| 3,236,170 | A | | 2/1966 | Meyer et al. |
| 3,311,047 | A | | 3/1967 | Smith et al. |
| 3,481,263 | A | | 12/1969 | Belden |
| 3,949,657 | A | | 4/1976 | Sells |
| 4,280,399 | A | | 7/1981 | Cunning |
| 4,325,290 | A | | 4/1982 | Wolfert |
| 4,554,862 | A | | 11/1985 | Wolfert |
| 4,876,950 | A | | 10/1989 | Rudeen |
| 4,903,445 | A | | 2/1990 | Mankowski ..... 52/199 |
| 4,924,761 | A | | 5/1990 | MacLeod et al. |
| 4,942,699 | A | * | 7/1990 | Spinelli ..... 52/57 |
| 4,957,037 | A | | 9/1990 | Tubbesing et al. |
| 4,962,692 | A | | 10/1990 | Shuert |
| 5,009,149 | A | * | 4/1991 | MacLeod et al. ..... 454/365 |
| 5,052,286 | A | | 10/1991 | Tubbesing et al. |
| 5,095,810 | A | | 3/1992 | Robinson ..... 454/365 |
| 5,122,095 | A | | 6/1992 | Wolfert ..... 454/365 |
| 5,167,579 | A | | 12/1992 | Rotter ..... 454/365 |
| 5,174,076 | A | | 12/1992 | Schiedegger et al. ..... 52/199 |
| 5,288,269 | A | | 2/1994 | Hansen ..... 454/365 |
| 5,326,318 | A | * | 7/1994 | Rotter ..... 454/365 |
| 5,457,920 | A | * | 10/1995 | Waltz ..... 52/199 |
| 5,673,521 | A | * | 10/1997 | Coulton et al. ..... 52/199 |
| 5,697,842 | A | * | 12/1997 | Donnelly ..... 454/365 |
| 5,772,502 | A | | 6/1998 | Smith ..... 454/365 |

(Continued)

*Primary Examiner*—Derek S. Boles
(74) *Attorney, Agent, or Firm*—Howson and Howson

(57) ABSTRACT

A roof ridge vent formed from a continuous, indeterminate-length, elongate strip of openwork material that has a pair of longitudinally-extending side edges each covered with a waterproof material. The edge coverings function as wind baffles and promote air circulation through the vent when wind blows over the roof ridge. The ridge vent is rollable lengthwise into a spiral roll for storage and shipment and is unrolled lengthwise during installation on a roof ridge.

18 Claims, 3 Drawing Sheets

U.S. PATENT DOCUMENTS 5,803,805 A * 9/1998 Sells ..... 454/364
5,830,059 A * 11/1998 Sells ..... 454/365
5,902,432 A 5/1999 Coulton et al. ..... 156/199
5,924,925 A * 7/1999 Nystrom ..... 454/365
5,960,595 A 10/1999 McCorsley, III et al. ..... 52/199
5,971,848 A 10/1999 Nair et al. ..... 454/365
6,149,517 A 11/2000 Hansen ..... 454/365
6,227,963 B1 5/2001 Headrick ..... 454/365
6,233,887 B1 5/2001 Smith ..... 52/199
6,260,315 B1 7/2001 Smith ..... 52/199
6,277,024 B1 8/2001 Coulton ..... 454/365
6,298,613 B1 10/2001 Coulton et al. ..... 52/199
6,299,528 B1 10/2001 Hansen ..... 454/365
6,308,472 B1 10/2001 Coulton et al. ..... 52/198
6,361,434 B1 3/2002 Brandon ..... 454/365
6,371,847 B2 4/2002 Headrick ..... 454/365
6,684,581 B2 * 2/2004 Robinson et al. ..... 52/198
2002/0100232 A1 8/2002 Robinson et al. ..... 52/198

* cited by examiner

ROLLABLE ROOF RIDGE VENT HAVING BAFFLES

CROSS-REFERENCE TO RELATED APPLICATIONS

This application claims the benefit under 35 USC §119(e) of U.S. Provisional Application No. 60/532,033, filed Dec. 22, 2003.

BACKGROUND OF THE INVENTION

The present invention relates to a roof ridge vent that enables air circulation from an underlying structure through a roof ridge, and more particularly, the present invention relates to a rollable roof ridge vent having wind baffles.

It is useful, and in many locales a building code requirement, that the attic area of a building be provided with a means to permit air exchange. Such ventilation prevents undue heat buildup, which can render the living quarters of the building uncomfortable and impose unreasonable energy requirements for cooling. Proper ventilation of the attic area also tends to preserve the structural integrity of the roof and roof coverings. One method of venting the roof structure consists of applying a venting media over a slot present along the ridge of a roof. These types of vents are known as ridge vents.

Examples of rollable ridge vents are provided by U.S. Pat. No. 5,960,595 issued to McCorsley et al.; U.S. Pat. No. 6,298,613 issued to Coulton et al.; U.S. Pat. No. 6,308,472 issued to Coulton et al.; U.S. Pat. No. 5,902,432 issued to Coulton et al.; U.S. Pat. No. 5,673,521 issued to Coulton et al.; and U.S. Pat. No. 4,942,699 issued to Spinelli. These patents are owned, or co-owned, by Benjamin Obdyke, Inc., the assignee of the present application. Such a vent may comprise a continuous, indeterminate-length, openwork web, or mat, that is capable of being rolled lengthwise in a spiral roll after or during manufacture and unrolled lengthwise during installation on a roof ridge.

Another type of roof ridge vent is a sectional ridge vent having wind baffles. Vents having wind baffles promote air circulation through the vent when wind blows over the roof ridge. This is because the wind blowing over the baffles creates areas of negative pressure that draws air out of the attic through the vent. Typically, such vents are injection-molded of high density polyethylene in four foot lengths and include a solid elongate top wall capable of accommodating the pitch of the roof, a pair of opposed outer sidewalls having a plurality of ventilation openings, and integrally-formed, outer, upturned flanges functioning as wind baffles. During installation of sectional ridge vents, a plurality of the vents are secured end-to-end on the roof ridge longitudinally from one end of the roof ridge to an opposite end.

Examples of rigid, non-rollable, sectional vents having wind baffles or the like are provided by U.S. Pat. No. 1,717,728 issued to Moore; U.S. Pat. No. 2,200,031 issued to Lee; U.S. Pat. No. 2,214,183 issued to Seymour; U.S. Pat. No. 2,704,500 issued to Bonforte; U.S. Pat. No. 2,868,104 issued to Honholt et al.; U.S. Pat. No. 2,799,214 issued to Roose; U.S. Pat. No. 3,185,070 issued to Smith; U.S. Pat. No. 3,236,170 issued to Meyer et al.; U.S. Pat. No. 3,311,047 issued to Smith et al.; U.S. Pat. No. 3,481,263 issued to Belden; U.S. Pat. No. 3,949,657 issued to Sells; U.S. Pat. No. 4,280,399 issued to Cunning; U.S. Pat. Nos. 4,325,290, 4,554,862 and 5,122,095 issued to Wolfert; U.S. Pat. No. 4,876,950 issued to Rudeen; U.S. Pat. No. 4,903,445 issued to Mankowski; U.S. Pat. Nos. 4,957,037 and 5,052,286 issued to Tubbesing et al.; U.S. Pat. No. 4,924,761 issued to MacLeod; U.S. Pat. No. 4,962,692 issued to Shuert; U.S. Pat. No. 5,094,041 issued to Kasner et al.; U.S. Pat. No. 5,095,810 issued to Robinson; U.S. Pat. No. 5,167,579 issued to Rotter; U.S. Pat. No. 5,174,076 issued to Schiedegger et al.; U.S. Pat. Nos. 5,288,269, 6,149,517 and 6,299,528 issued to Hansen; U.S. Pat. No. 5,772,502 issued to Smith; U.S. Pat. No. 5,971,848 issued to Nair et al.; U.S. Pat. No. 6,277,024 issued to Coulton; and U.S. Pat. Nos. 6,227,963 and 6,371,847 issued to Headrick.

Ridge vents that have baffles and that are rollable are disclosed by U.S. Pat. Nos. 6,233,887 and 6,260,315 issued to Smith, U.S. Pat. No. 6,361,434 issued to Brandon, and U.S. Patent Application Publication No. 2002/0100232 A1 of Robinson et al.

The Smith '887 and '315 patents disclose roof ridge vents similar in appearance and structure to conventional, injection-molded, sectional ridge vents. To this end, they are molded of solid plastic material with a solid top wall, end walls, leg supports, and grooved vent apertures. The Smith vents have undulating sidewalls that form wind baffles and permit the vent to be rolled into a spiral.

The Robinson '232 published patent application discloses a vent similar to that disclosed by the Smith '887 and '315 patents. However, Robinson has vent apertures formed in its otherwise solid top wall and has sidewalls constructed of a plurality of staggered rows of separate V-shaped baffles. The V-shaped baffles of the sidewall permit the roof ridge vent to be rolled into a spiral configuration.

The Brandon patent discloses a rollable corrugated roof ridge vent that has separately attached wind baffles. The baffles are L-shaped in transverse cross-section, collapse and expand in an accordion manner, and are rolled with the corrugated vent into a spiral.

While the various ridge vents disclosed in the above referenced patents may function satisfactorily under certain circumstances, there is a need for an improved ridge vent that has wind baffles and that is provided in spiral rolls. The ridge vent should be capable of being provided in lengths enabling the installation of a single continuous vent along a roof ridge and should be capable of being readily and properly installed in a manner requiring labor skills possessed by the average roof installer. The ridge vent should have a low height profile yet provide an acceptable amount of air venting capacity, and should prevent the entry of weather, insects and the like into the ridge opening. In addition, the ridge vent should be capable of cost-efficient manufacture. For instance, preferably the ridge vent should be made in a continuous process that forms a single continuous vent and that does not require a plurality of separately-formed vent-sections to be secured together.

With the foregoing in mind, a primary object of the present invention is to provide an efficient and economical roof ridge vent that has wind baffles and can be provided in spiral rolls.

Other objects of the present invention are to provide a roof ridge vent that provides an acceptable amount of air venting capacity, that prevents weather infiltration, and that is capable of being readily and properly installed in a manner requiring labor skills possessed by an average roof installer.

SUMMARY OF THE INVENTION

More specifically, the present invention provides a roof ridge vent that is rollable lengthwise into a spiral roll for storage and shipment and that is unrollable lengthwise during installation on a roof ridge. The vent is made from a continuous, indeterminate-length strip of openwork material having upper and lower faces and a pair of longitudinal side edges covered by a material impermeable to air and water. The edge coverings function as wind baffles and promote air circulation through the vent when wind blows over the roof ridge.

According to another aspect of the present invention, a roof ridge vent assembly is provided. The assembly includes a roof ridge having an open elongate slot, a ridge vent secured to said roof ridge overlying said open elongate slot, and cap shingles secured in a position overlying the ridge vent and elongate slot. The ridge vent is a continuous, indeterminate-length, rollable strip of openwork material having upper and lower faces and a pair of longitudinal side edges covered by a material impermeable to air and water. The edge coverings function as wind baffles and promote air circulation through the vent when wind blows over the roof ridge. The ridge vent has a width than is greater than the width of the cap shingles so that the cap shingles cover only a central longitudinally-extending section of the ridge vent and permits outer, longitudinally-extending, edge sections of the upper face of the vent to remain exposed to provide ventilation openings. Thus, a path of ventilation is provided through the open elongate slot of the roof ridge, into the lower face of the openwork material, and out of the exposed outer, longitudinally-extending, edge sections of the upper face of the openwork material.

BRIEF DESCRIPTION OF THE DRAWINGS

The foregoing and other objects, features and advantages of the present invention should become apparent from the following description when taken in conjunction with the accompanying drawings, in which.

DETAILED DESCRIPTION OF THE PREFERRED EMBODIMENTS

Figure 1:
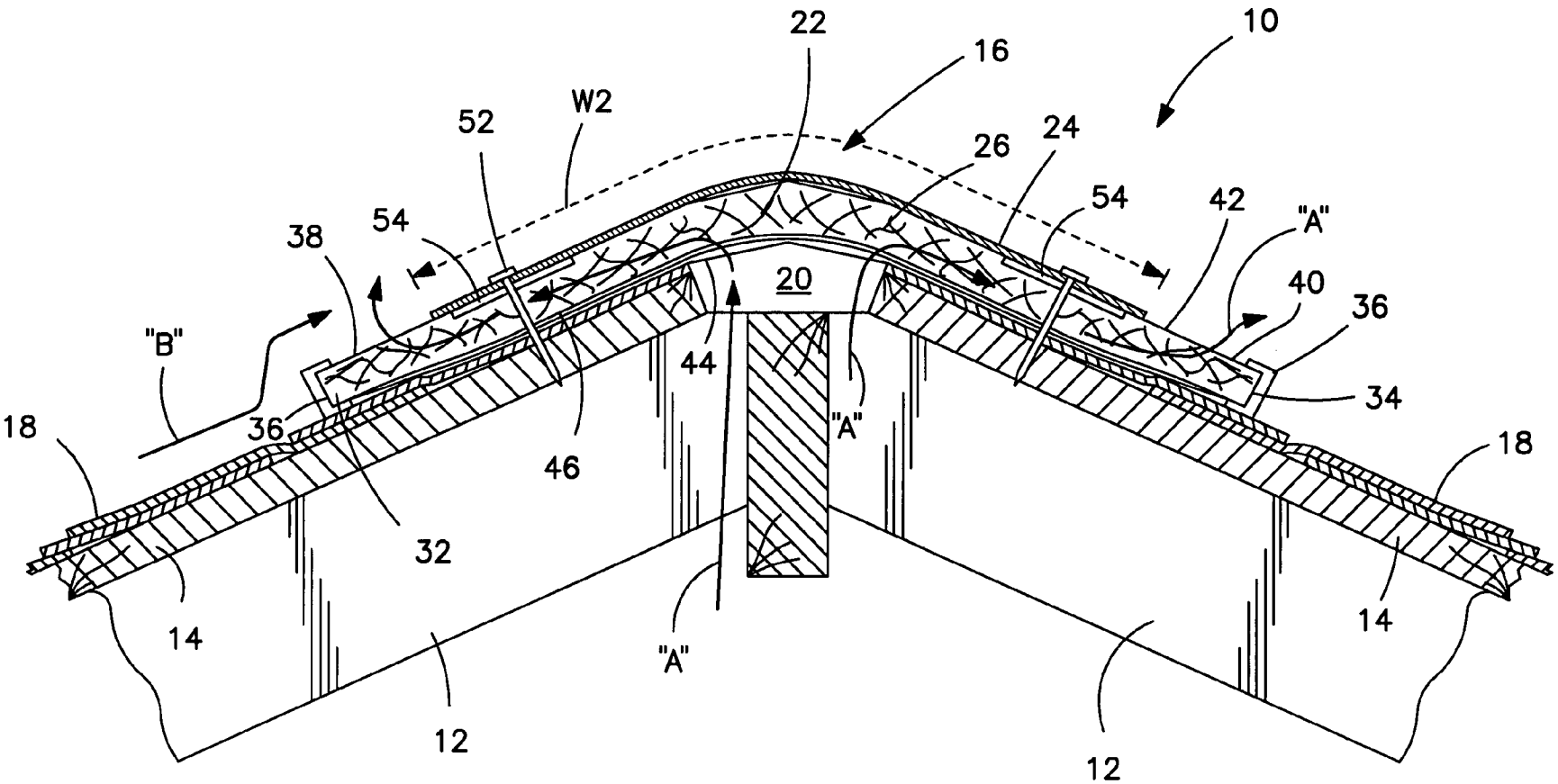
FIG. 1 is an elevational cross-sectional view of a ridge vent installed on a roof ridge according to the present invention.

Referring now to the drawings, FIG. 1 illustrates a roof 10 having a typical construction which utilizes a ridge vent. The roof 10 is constructed from a plurality of rafters 12 supported at their lower ends by front and rear walls (not shown) of the building. A roof deck 14 is typically constructed of plywood, or other suitable panels, to provide an outer sheathing of the building. The roof deck 14 is secured to the rafters 12, extends to the end walls, and forms a ridge, or peak, 16. Shingles 18 are secured to the roof deck 14 to finish sloping portions of the roof 10 in accordance with conventional construction practices. An open elongate slot 20 is provided along a length of the roof ridge 16 to provide a passageway for air to vent from the underlying attic area to the ambient atmosphere.

A ridge vent 22 and cap shingles 24 are installed on the ridge 16 overlying the slot 20. The ridge vent 22 according to the present invention is made of a continuous, elongate strip of an openwork material 26 that provides a plurality of ventilation passageways enabling air to vent from the open slot 22 to the ambient atmosphere as illustrated in FIG. 1 by arrows "A". Preferably, the vent 22 has a lengthwise extending centerline hinge or the like so that, when it is installed on the roof ridge 16, the vent 22 has an inverted V-shaped transverse cross-section to conform to the shape of the roof ridge 16. See FIG. 1.

Figure 2:
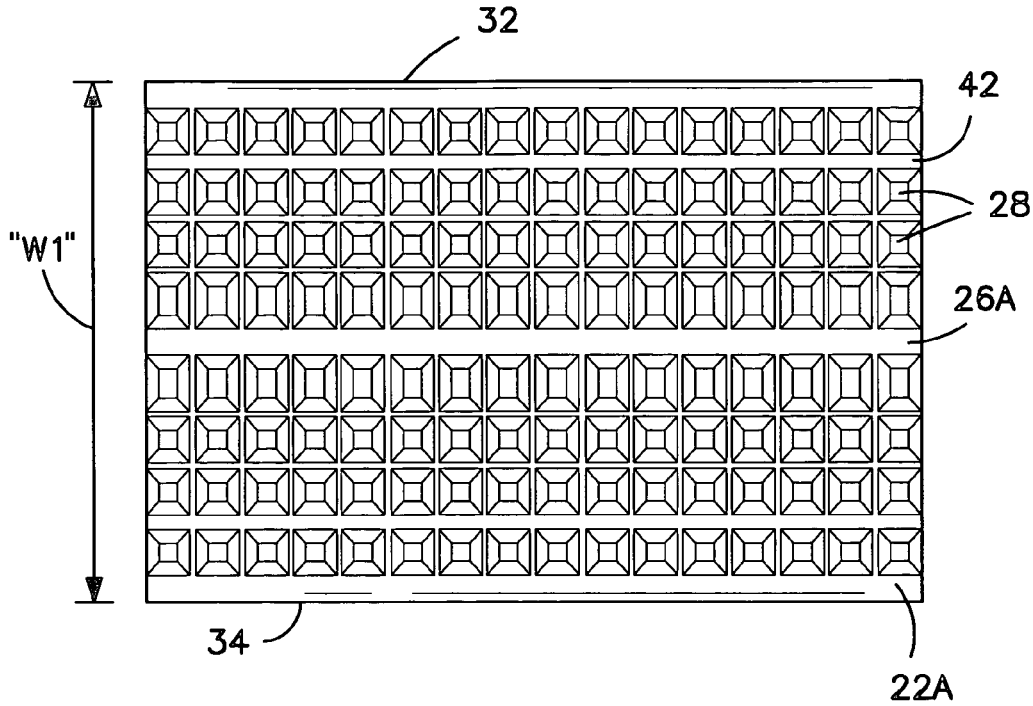
FIG. 2 is a top plan view of an unrolled section of another embodiment of a ridge vent according to the present invention.
Figure 3:
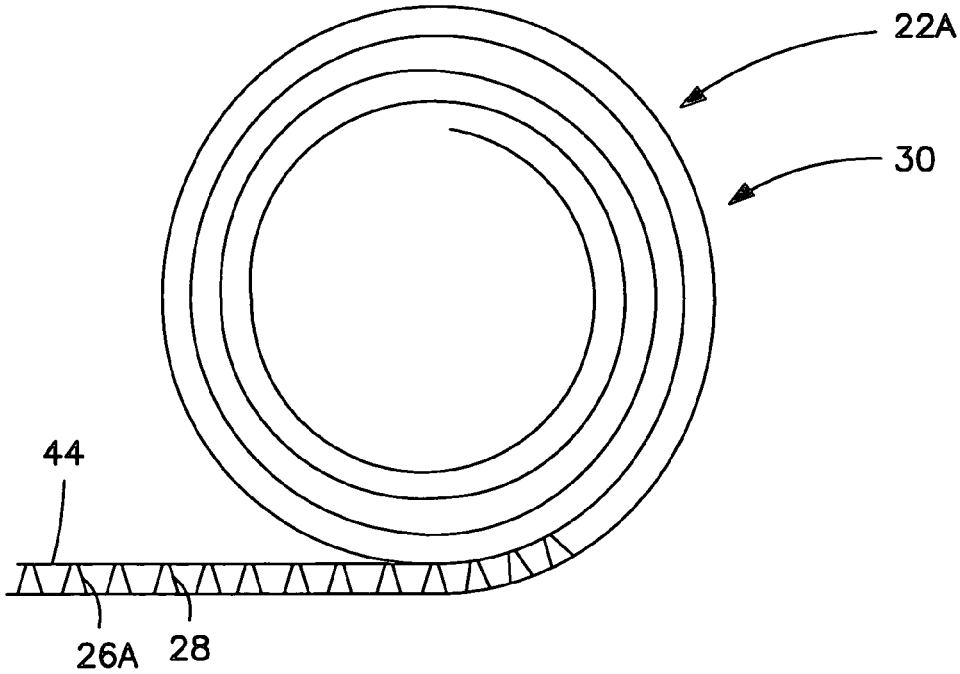
FIG. 3 is a side elevational view of a spiral roll of a ridge vent according to the present invention.
Figure 4:
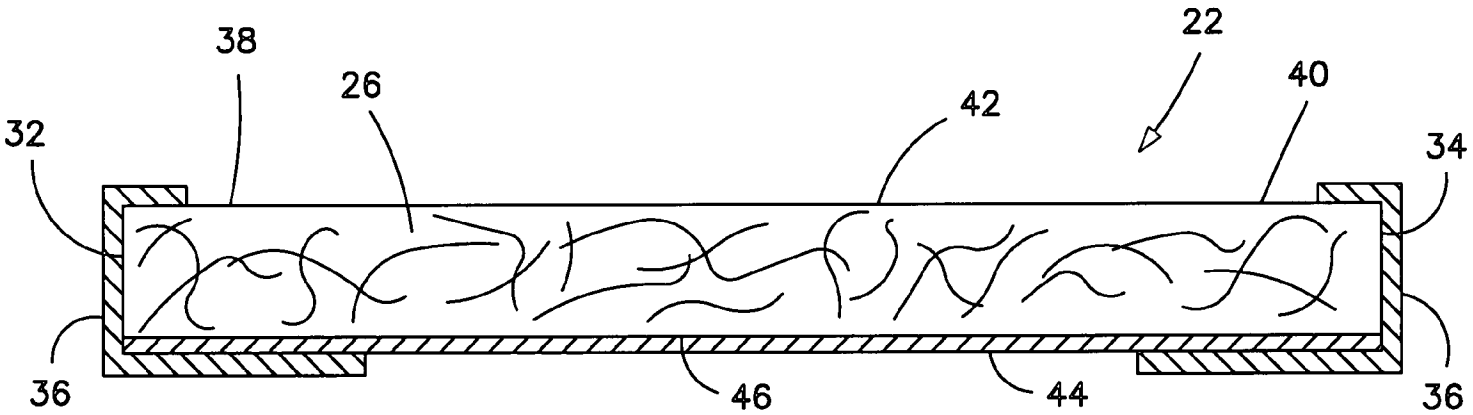
FIG. 4 is a cross-sectional view of a ridge vent according to the present invention.
Figure 5:
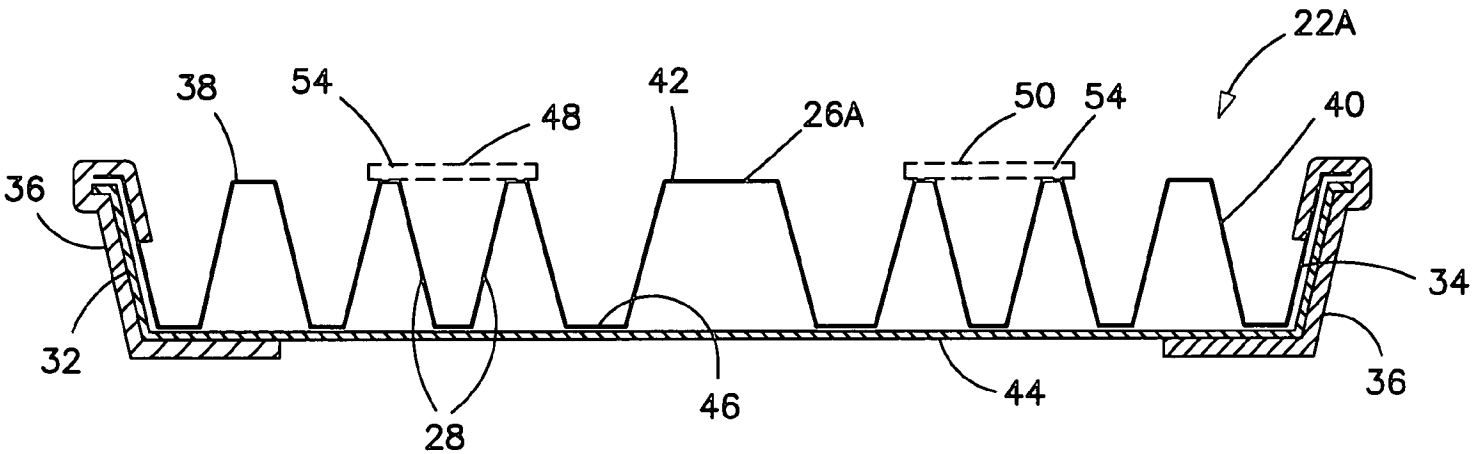
FIG. 5 is a cross-sectional view of another embodiment of a ridge vent according to the present invention.

Various types of material can be utilized as the openwork material 26 in the ridge vent according to the present invention. For example, the openwork material 26 shown in FIGS. 1 and 4 is a fibrous mat made of filaments or the like and/or can be similar to that disclosed in U.S. Pat. No. 4,942,699 issued to Spinelli. Alternatively, the openwork material 26A, as shown in FIGS. 2, 3 and 5, can be a sheet of randomly convoluted polymeric filaments formed with a plurality of cusps, or hollow spacer elements, 28, for instance, as disclosed in U.S. Pat. No. 5,960,595 issued to McCorsley et al. and U.S. Pat. No. 6,298,613 issued to Coulton et al. Instead of cusps 28, the openwork material 26A can be formed as a corrugated sheet of randomly convoluted polymeric filaments to provide the material with the needed depth or thickness. The openwork material can also be made of a solid corrugated material. Yet another alternative includes the use of a thermoplastic web of material formed with hollow spacer elements as disclosed in U.S. Pat. Nos. 6,308,472, 5,902,432 and 5,673,521 issued to Coulton et al. The thermoplastic web of material can be formed, for instance, in the same or similar shape to that shown in FIGS. 2, 3 and 5 for openwork material 26A. However, a thermoplastic web of material would require ventilation apertures to be formed in the top wall thereof adjacent both longitudinally-extending side edges of the web. The disclosures of U.S. Pat. No. 5,960,595 issued to McCorsley et al.; U.S. Pat. No. 6,298,613 issued to Coulton et al.; U.S. Pat. No. 6,308,472 issued to Coulton et al.; U.S. Pat. No. 5,902,432 issued to Coulton et al.; U.S. Pat. No. 5,673,521 issued to Coulton et al.; and U.S. Pat. No. 4,942,699 issued to Spinelli are incorporated herein by reference.

The openwork material, 26 and 26A, is of a length sufficient to extend across the entire length of a roof ridge. Thus, the ridge vent, 22 and 22A, is installed as a single, continuous structure. As illustrated in FIG. 3, all the embodiments of the ridge vent according to the present invention are rollable and are stored and or transported in spiral rolls 30. To this end, the ridge vents, 22 and 22A, are rolled lengthwise into a spiral roll during or shortly after manufacture and are unrolled lengthwise during installation on a roof ridge.

Each vent, 22 and 22A, has an opposed pair of longitudinally-extending side edges, 32 and 34, to which is secured a waterproof, UV-resistant material 36 that is impermeable to air and water. Thus, as best illustrated in FIG. 1, air circulating through the vent cannot exit via the side edges 32 and 34; rather, the circulating air escapes to the ambient atmosphere through outer sections, 38 and 40, of an upper face 42 of the vent located on opposite sides of the cap shingles 24. The purpose of the waterproof material 36 is to provide the vent, 22 and 22A, with wind baffles. To this end, wind blowing along the roof, as shown by arrow "B" in FIG. 1, is deflected over the wind baffles and thereby creates a negative pressure above sections 38 and 40 which draws air out of the attic through the open slot 20 and vent.

Preferably, the waterproof material 36 is provided by a strip of rubber, flexible plastic, an elastomeric material, or the like that is resistant to ultraviolet (UV) light. The waterproof material 32 can be bonded to the openwork material, 26 and 26A, with an adhesive or the like, or via lamination techniques utilizing heat and pressure. Drainage apertures (not shown) may be provided in the waterproof material 36 at predetermined intervals along the length of the vent to permit any moisture entering the vent through sections 38 and 40 to exit along the sloped roof in a direction away from the open slot 22 of the roof ridge 16.

An air permeable filter material 44 is secured to at least a portion of a lower face 46 of the vents, 22 and 22A to prevent rain, snow, blowing debris, insects and the like from entering through the open slot 20. To this end, the lower face 46 of the vent 22 and filter material 44 span across and cover the open slot 20 when the vent is installed on the roof ridge. See FIG. 1. Examples of filter material 44 include, for instance, a sheet-like fabric of non-woven nylon polyester or high loft material, a needle-punched non-woven material, a metal mesh screen, or any like material that provides air permeability through small spaces in its structure. Preferably, the air permeable filter material 44 is thermally or adhesively bonded to the openwork material, 26 and 26A.

Preferably, nail lines 48 and 50 are identified on the upper face 42 of the vents, 22 and 22A, for aiding proper placement of nails 52 by the installer. An option is to utilize nail line reinforcement material 54 that is affixed to the upper face 42 of the vents along the nail lines. For example, see FIGS. 1 and 5. The nail line reinforcement material 54 provides a support surface for nail heads and prevents the head of nails from sinking through the cap shingles 24. The nail line reinforcement material 54 can be a fabric or elastomeric material and/or the same material used for the air permeable filter material 44.

As shown in the assembly of FIG. 1, the vent 22 has a greater width "W1" than the width "W2" of the cap shingles 24. Thus, outer longitudinally-extending sections, 38 and 40, of the upper face 42 of the vent 22 remain exposed to the ambient atmosphere thereby providing a opening for air venting through the vent 22. See arrows "A" in FIG. 1.

A method of manufacturing a vent according to the present invention includes forming a continuous, indeterminate-length openwork mat having an upper face, a lower face, and a pair of longitudinal side edges. The continuous openwork mat should be of a length sufficient to span across a full length of a roof ridge. Examples of processes for forming a continuous vent structure are disclosed by U.S. Pat. No. 5,960,595 issued to McCorsley et al.; U.S. Pat. No. 6,298,613 issued to Coulton et al.; U.S. Pat. No. 6,308,472 issued to Coulton et al.; U.S. Pat. No. 5,902,432 issued to Coulton et al.; U.S. Pat. No. 5,673,521 issued to Coulton et al.; and U.S. Pat. No. 4,942,699 issued to Spinelli, the disclosures of which are incorporated herein by reference.

The method also includes the step of securing an air and water impermeable, UV-resistant material to the openwork mat so that the longitudinal side edges of the openwork mat are covered by the material and provide the vent with wind baffles. For example, the waterproof material can be bonded to the openwork material with an adhesive or the like, or via lamination techniques utilizing heat and pressure. If desired, an air permeable filter material can be secured to at least a portion of a lower face of the vent to prevent the passage of rain, snow, blowing debris, insects and the like through the lower face of the vent, and/or nail line reinforcement material can be affixed to the upper face of the vent along its nail lines to provide a support surface for nail heads.

After said securing step, the vent is rolled lengthwise into a spiral roll for storage and/or shipment. Thus, the vent is manufactured in a continuous process which does not require separately-manufactured sections to be secured end-to-end to form the full length of a vent.

The above-described ridge vent according to the present invention provides a ridge vent which is inexpensive to manufacture and easy to install. Required continuous lengths of the vent can be efficiently stored and transported in a spiral roll and can be unrolled during installation on a roof ridge. The installed vent has wind baffles which promote the circulation of air therethrough when wind blows across the roof. Various modifications can be made to the vent such as its size, thickness and venting capability.

While preferred ridge vents have been described in detail, various modifications, alterations, and changes may be made without departing from the spirit and scope of the vent according to the present invention as defined in the appended claims.

The invention claimed is:

1. A roof ridge vent assembly, comprising:

a roof ridge with an open elongate slot, a ridge vent secured to said roof ridge overlying said open elongate slot, and at least one cap shingle secured in a position overlying said ridge vent and open elongate slot;

said roof ridge vent being a rollable, continuous, indeterminate-length, strip of openwork material having an upper face, a lower face, and a pair of longitudinal side edges each covered with an air and water impermeable material, said material covering said longitudinal side edges providing wind baffles that promote air circulation when wind blows over said roof ridge;

said vent having a width greater than a width of said cap shingle so that said cap shingle overlies only a central longitudinally-extending section of said ridge vent and permits outer, longitudinally-extending, edge sections of said upper face of said ridge vent to remain exposed to provide ventilation openings; and said assembly providing a path of ventilation through said open elongate slot, into said lower face of said openwork material, and out of said exposed outer, longitudinally-extending, edge sections of said upper face of said openwork material.

2. A roof ridge vent assembly according to claim 1, wherein said openwork material is made of a mat of filaments.

3. A roof ridge vent assembly according to claim 2, wherein said mat of filaments is a layer of a plurality of randomly convoluted polymeric filaments formed with cusps.

4. A roof ridge vent assembly according to claim 1, wherein said openwork material is a thermoformable plastic material formed with cusps.

5. A roof ridge vent assembly according to claim 1, wherein said openwork material is a corrugated material.

6. A roof ridge vent assembly according to claim 2, wherein said air and water impermeable material is UV resistant and is selected from the group consisting of a rubber, a flexible plastic, and an elastomeric material.

7. A roof ridge vent assembly according to claim 6, further comprising an air permeable filter material bonded to said lower face of said openwork material for preventing weather infiltration through said vent.

8. A roof ridge vent assembly according to claim 7, wherein said air permeable filter material is selected from the group consisting of a fabric, a non-woven nylon polyester fabric, a high loft fabric, a needle-punched non-woven material, and a metal mesh screen.

9. A roof ridge vent assembly according to claim 8, further comprising at least one continuous length of nail line reinforcement material attached on said upper face of said mat to reinforce an area of said mat through which nails extend to the roof.

10. A roof ridge vent assembly according to claim 9, wherein said nail line reinforcement material is selected from the group consisting of a fabric and an elastomeric material.

11. A roof ridge vent assembly according to claim 8, wherein said openwork material has a lengthwise extending centerline hinge so that, when installed on the roof ridge, said openwork material has an inverted V-shaped transverse cross-section to conform to the roof ridge.

12. A roof ridge vent assembly according to claim 1, wherein said air and water impermeable material is UV resistant.

13. A roof ridge vent assembly according to claim 1, wherein said air and water impermeable material is selected from the group consisting of a rubber, a flexible plastic, and an elastomeric material.

14. A roof ridge vent assembly according to claim 1, further comprising an air permeable filter material bonded to said lower face of said openwork material for preventing weather infiltration through said vent.

15. A roof ridge vent assembly according to claim 14, wherein said air permeable filter material is selected from the group consisting of a fabric, a non-woven nylon polyester fabric, a high loft fabric, a needle-punched non-woven material, and a metal mesh screen.

16. A roof ridge vent assembly according to claim 1, further comprising at least one continuous length of nail line reinforcement material attached on said upper face of said mat to reinforce an area of said mat through which nails extend to the roof.

17. A roof ridge vent assembly according to claim 16, wherein said nail line reinforcement material is selected from the group consisting of a fabric and an elastomeric material.

18. A roof ridge vent assembly according to claim 1, wherein said openwork material has a lengthwise extending centerline hinge so that, when installed on the roof ridge, said openwork material has an inverted V-shaped transverse cross-section to conform to the roof ridge.

* * * * *